US005524358A

United States Patent [19]

Matz

[11] Patent Number: 5,524,358

[45] Date of Patent: Jun. 11, 1996

[54] DISHWASHER VENTILATION FILTRATION KIT

[76] Inventor: Warren W. Matz, 882 U.S. Highway 1, Juno Beach, Fla. 33408

[21] Appl. No.: 410,042

[22] Filed: Mar. 24, 1995

[51] Int. Cl.[6] ..... F26B 3/34

[52] U.S. Cl. ..... 34/275; 34/235; 55/279; 55/385.1

[58] Field of Search ..... 34/233, 235, 275; 55/279, 385.1, 467, 473; 95/273

[56] References Cited

U.S. PATENT DOCUMENTS

| | | | |
|---|---|---|---|
| 3,026,628 | 3/1962 | Berger, Sr. et al. | 34/231 |
| 3,092,122 | 6/1963 | Guth | 134/58 |
| 3,387,388 | 6/1968 | Williamson | 34/234 |
| 3,513,567 | 5/1970 | Paul | 34/233 |
| 3,571,939 | 3/1971 | Paul | 34/1 |
| 3,908,681 | 9/1975 | Schimke et al. | 134/94 |
| 3,915,180 | 10/1975 | Jacobs | 134/58 |
| 4,064,888 | 12/1977 | Diebel | 134/182 |
| 4,709,488 | 12/1987 | Anselmino et al. | 34/235 |

*Primary Examiner*—Henry A. Bennett
*Assistant Examiner*—Dinnatia Doster
*Attorney, Agent, or Firm*—McHale & Slavin

[57] ABSTRACT

The instant invention is a ventilation filtration kit for use with residential and commercial dishwashers. The filtration kit consists of a flexible duct that is coupled to the ventilation intake of the dishwasher having a filter located on one end of the duct to provide clean air into the dishwasher. The flexible duct allows for placement of the filter in a remote position such as adjacent to the dishwasher. Placement of the filter in a cabinet allows for the induction of air free of debris which typically accumulates beneath a dishwasher. Additional provisions are made for placement of a germicidal lamp within the flexible duct made operational by a sail switch providing operation of the ozonator upon demand. An electric fan may also be placed within the duct for drawing air into a convection type dishwasher or for use in drawing air from a distant location.

20 Claims, 11 Drawing Sheets

DISHWASHER VENTILATION FILTRATION KIT

FIELD OF THE INVENTION

This invention relates to dishwashers and more particularly to a ventilation filtration kit for use in treating the air drawn into a dishwasher during the drying cycle.

BACKGROUND OF THE INVENTION

Automatic dishwashers are modern day devices used to alleviate the burden of cleaning dishes, glasses, pots and pans and associated eating utensils. Manual dish washing typically includes the step of drying the washed items immediately after cleaning by use of a towel. An automatic dishwasher raises the temperature within the dishwasher compartment after a cleaning cycle for the purpose of evaporating the moisture on the dishes.

For instance, a common dishwasher utilizes a resistive heating element which is energized during a drying cycle. As the element becomes hot, air circulation forms by convection causing air to flow upward through the wash chamber. The hot humid air is allowed to escape by vents located near the top of the wash chamber. Convection allows cool air to be drawn into the washing chamber, typically from a lower vent, allowing the circulation which assists in the drying cycle.

Another type of dishwasher employs a forced air circulation system. A blower fan is positioned external to the wash chamber which forces air into the chamber to expedite the natural convection process of expelling moisture laden air for enhancing the drying cycle. Variations to the air circulation in dishwashers are also well known in the art such as passing air downwardly through the wash chamber during drying to oppose the natural convection currents for the purpose of enhancing the drying cycle.

A problem with dishwashers to which this invention addresses, is that despite the convenience and efficiency of dishwashers the drying cycle requires outside air to be drawn into the washing chamber. The result is contamination of the dishes. For example, to take advantage of the natural convection process most dishwashers have an air intake located as close to the floor as possible. Typically the air intake is hidden behind a panel beneath the washing chamber. These intake openings allow large particles such as dirt, hair, lint, bugs, and so forth to enter the dishwasher compartment. Every home owner who has moved a refrigerator, clothes washing machine, or clothes dryer is well aware of the amount of dirt that collects beneath the device. Such an area has limited ventilation allowing a moisture enriched environment which assists in the trappage of airborne particles. Further, while a refrigerator, clothes washer, or clothes dryer may be moved allowing a homeowner to clean behind the unit, such is not the case with a dishwasher which is secured to the cabinetry and designed not to be moved. For this reason, a dishwasher air intake located in an environment that can trap particles will easily draw such debris into the dishwasher. This is dangerous for a person having health related problems. Airborne particles may cause an asthma attack while bacterial spores may cause an allergic reaction or result in stomach viruses. Unbeknown to the general consumer, the temperatures within a dishwasher system are not sufficient to allow for disinfection as a dishwasher does not operate as an autoclave. Even if a dishwasher could be designed to spray scalding water throughout the unit, the drying cycle may counteract any disinfection upon the introduction of foreign matter during the drying cycle. The drying cycle does not raise the temperature in a wash chamber to a point of killing the bacteria as the purpose of the drying cycle is to remove moisture. The warm moist environment will actually enhance the bacteria growth on the dishes. The bacteria may be consumed by an individual should the food be mixed over live bacteria spores.

Bacteria range in the size from 0.4 to 5 microns and can breed beneath the dishwasher. A conventional air ventilation system draws the air from the floor which operates as a breeding ground for the bacteria allowing the bacteria to be sloughed off into the ventilation system. Viruses are much smaller, ranging in size from approximately 0.003 to 0.06 microns and can be easily drawn into the dishwasher by convection.

While the use of filters for treating air is known in the art, the use of a filter for dishwashers is not known. Furthermore, a filter that is not positioned correctly may operate as an organism amplifier. It is not uncommon to find an improperly placed filter on a furnace that is wet when no other water is apparent, the moisture content being the advent of bacteria slime. Even if filters are changed regularly it is not uncommon to find poorly placed filters filled with penicillium spores. If the filter is hard to replace, the spores may be released into a ventilation system defeating the purpose of the filter.

Thus, what is lacking in the art is an affordable air treatment system for use with a conventional dishwasher capable of reducing or eliminating airborne debris and further providing a means for converting a conventional dishwasher into a germicidal free enclosure.

SUMMARY OF THE INVENTION

The instant invention is a dishwasher ventilation filtration kit adaptable to any residential or commercial dishwasher. The filtration kit consists of a primary filter capable of trapping airborne debris such as pollen, lint, dust, hair, and so forth. As low as a 5 micron filter may be used for convection systems, 5 micron or less may be used on dishwashers having air recirculation fans. The filter kit consists of a duct capable of positioning a filter away from the warm moist area beneath the dishwasher and allowing the filter to be positioned in an area that is readily accessible and not susceptible to the induction of the aforementioned airborne debris. In addition, provisions are made for the inclusion of a germicidal lamp to provide a residual ozone to be inducted into the dishwasher chamber. Ozone is a natural dissipating oxidant that destroys bacteria on contact.

The kit has a flexible duct constructed of plastic, plastic coated paper, or aluminum foil which is coupled to the intake port of a recirculation fan. The opposite end of the duct is placed remotely from the dishwasher enclosed cavity. Preferably the filter is placed in a cabinet adjacent to the dishwasher allowing a filter to be raised off the floor thereby lessening the load on the filter. For instance, a filter may be located in a cabinet beneath a sink adjacent to the dishwasher, as the dishwasher utilizes the drain of the sink for expelling of waste water. In this installation, the filter is placed along a side wall of the cabinet wherein air inducted into the dishwasher is pulled from inside the cabinet thus eliminating the possibility of picking up floor debris which gathers beneath the dishwasher. In addition, the location of the filter beneath the sink or any other cabinet provides a source of clean dry air that is not latent with moisture extending the replacement of the filter and making access to the filter most convenient.

An alternative embodiment of the instant invention includes an ultraviolet light placed within the duct which carries the filtered air to the ventilation intake. The ultraviolet light radiates the air passing through the duct for destruction of mildew, algae, fungus, viruses, spores, and the like health threatening germs. A sail switch is used to complete an electrical circuit to the light. Thus, an objective of the instant invention is to set forth a filtration system for use in residential or commercial dishwashers to prevent airborne particles from being drawn into the wash compartment allowing the intake of clean particle free air.

Yet another objective of the instant invention is to position the air intake of a dishwasher from a location notorious for trapping dead insects, hair, and the like debris to a location allowing clean air intake to prevent such debris from being pulled into the dishwasher.

Still another objective of the instant invention is to teach the placement of a filter in an adjacent cabinet to a dishwasher allowing for ease of filter replacement.

Yet still another objective of the instant invention is to teach the use of an ozonator for destruction of bacteria and viruses.

Yet still another objective of the instant invention is to teach the use of a filter and ozonator apparatus that is coupled to a conventional household electrical outlet using a sensor to make the ozonator operational during the drying cycle without coupling to the electrical circuitry of the dishwasher.

Other objectives and advantages of this invention will become apparent from the following description taken in conjunction with the accompanying drawings wherein are set forth by way of illustration and example certain embodiments of this invention. The drawings constitute a part of this specification and include exemplary embodiments of the present invention and illustrate various objectives and features thereof.

DETAILED DESCRIPTION OF THE PREFERRED EMBODIMENT

Although the invention will be described in terms of a specific embodiment, it will be readily apparent to those skilled in the art that various modifications, rearrangements and substitutions can be made without departing from the spirit of the invention. The scope of the invention is defined by the claims appended hereto.

Figure 1:
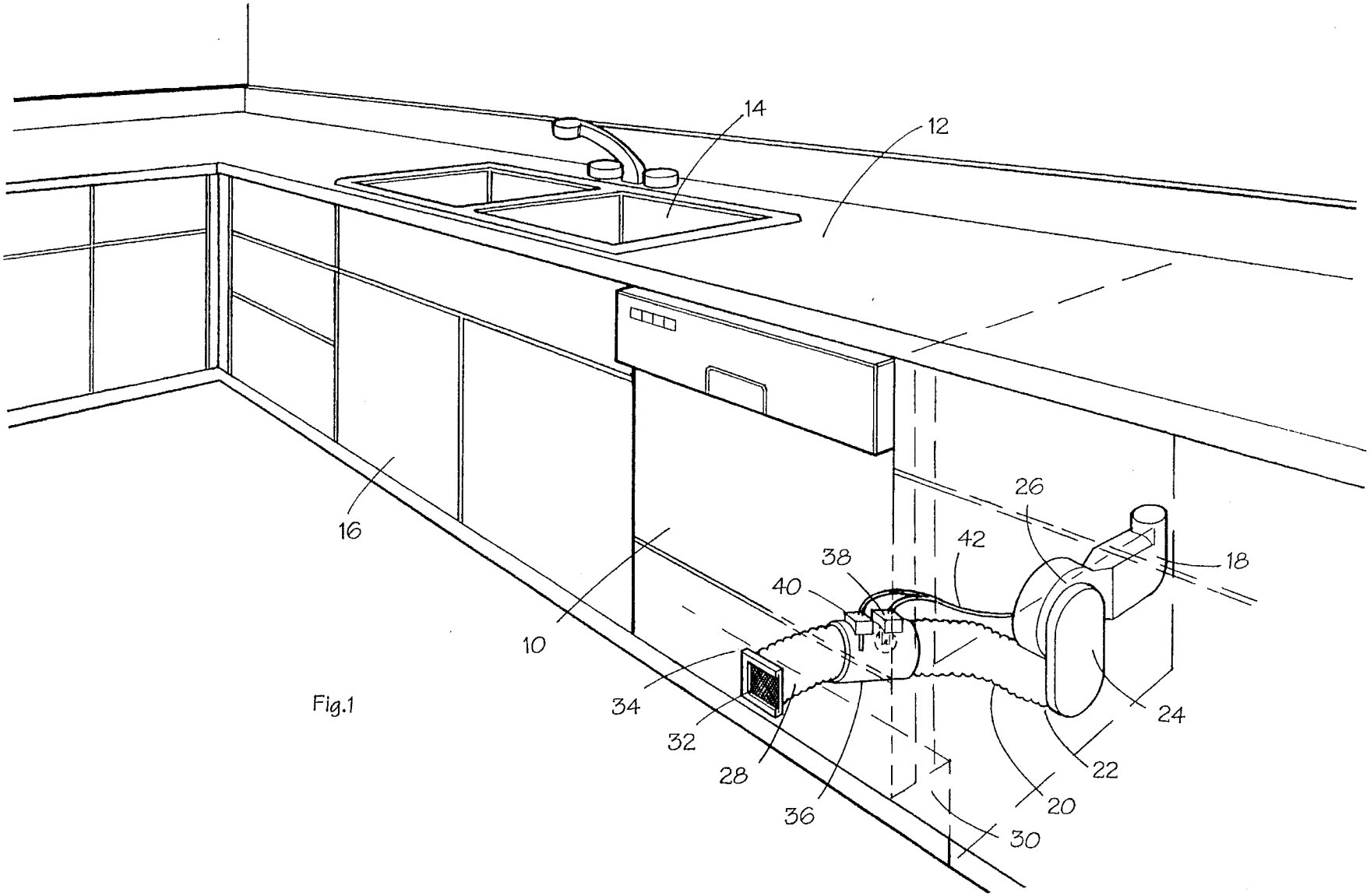
FIG. 1 is a pictorial view illustrating a dishwasher with the instant invention coupled in-line to the air intake of a recirculation fan with a filter positioned on a front panel of the dishwasher.

Now referring to FIG. 1 illustrated is a kitchen having a dishwasher 10 placed beneath a counter top 12. Within the counter top 12 is a sink 14 with cabinets 16 beneath the sink. The dishwasher 10 has a recirculation fan 18 used during the drying cycle of the dishwasher. The invention consists of a filtration kit for treating of air drawn into the recirculation fan 18 from a source beneath the dishwasher 10. Flexible duct 20 constructed of plastic, plastic coated paper, or aluminum is coupled directly to the recirculation fan 18 at first end 22. A U-shaped chamber 24 is provided for instances where intake 26 is located on one side surface of recirculation fan 18 and directed against a side wall. The chamber 24 allows coupling to the intake by use of a solid plastic housing having a similar shaped inlet and outlet disposed on one side surface. The duct 20 has an end 28 mounted along a toe kick surface 30. Filter 32 is slid into attachment filter support bracket 34 sealing the inlet to all but air that is drawn through the filter 32. As further described later in the specification, the air intake end 28 may be located in an inner cabinet adjacent to the dishwasher such as by placement within cabinet 16 below the sink 14.

Figure 2:
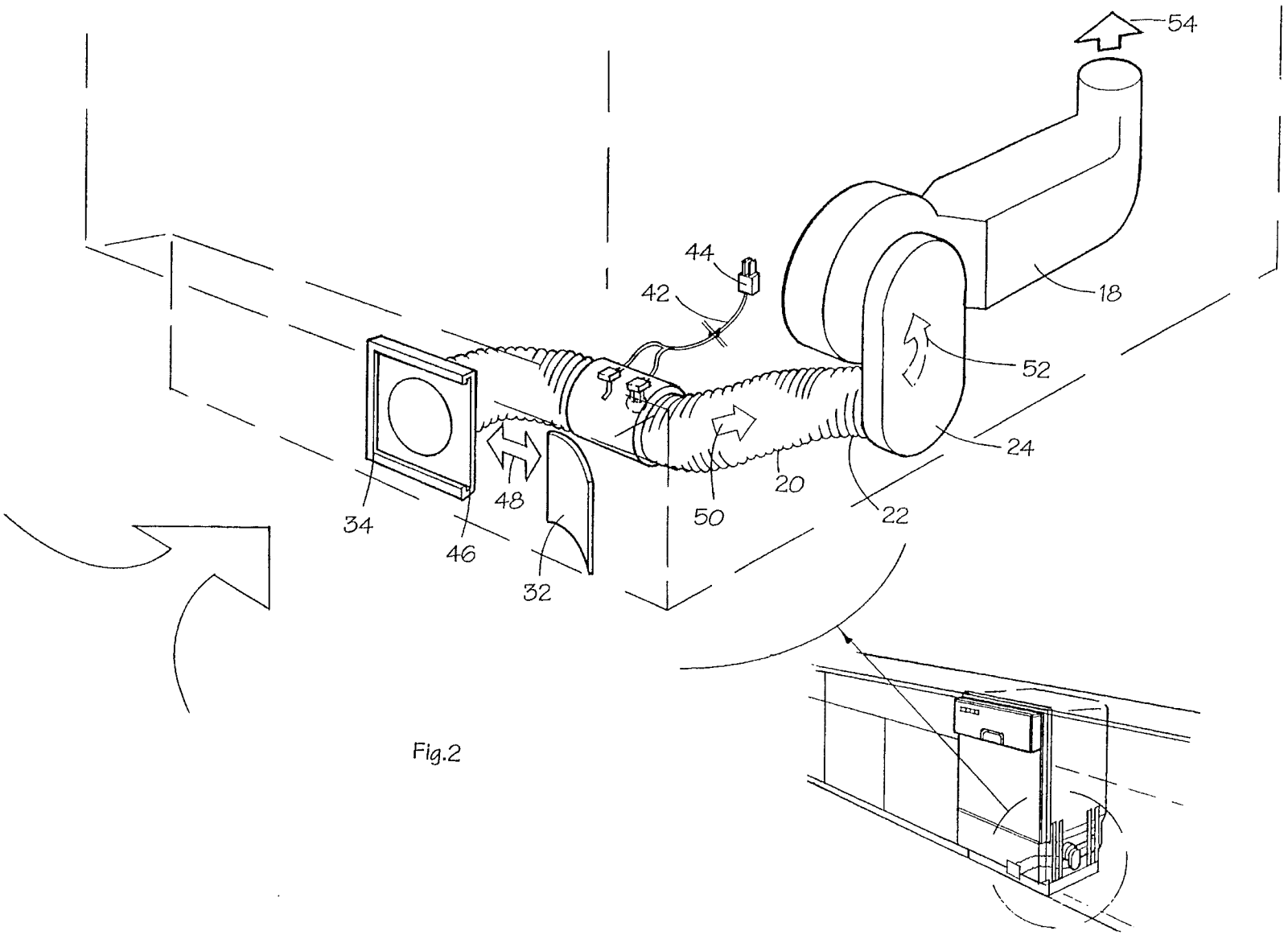
FIG. 2 is a pictorial view of the components illustrated in FIG. 1 illustrating air flow and filter insertion.

In an alternative embodiment, duct 20 includes a self-contained ozonator chamber 36 providing support for germicidal lamp 38 and activator switch 40. In operation, when the dishwasher enters a drying cycle, air is recirculated through the dishwasher by a recirculation pump which draws air through filter 32. Sail switch 40 is activated by the air stream and is electrically coupled to the germicidal lamp 38 which is energized to provide destruction of bacteria and viruses. An electrical cord 42 may be coupled to the fan motor within recirculation fan 18 to eliminate the sail switch. Preferably the cord is independent and plugged into an electrical outlet separate and distinct from the dishwasher. FIG. 2 is an enlargement of FIG. 1 setting forth the U-shaped chamber 24 and recirculation fan 18. Shown in this illustration is the electrical cord 42 having an electrical plug 44 using dual prongs for placement into a 110 volt electrical socket. The filter support bracket 34 has a U-shaped channel bracket 46 which allows for the slidable insertion of filter 32 shown by arrow 48. When the recirculation fan 18 is on, air is drawn through the duct in the direction of arrow 50 to first inlet end 22 of chamber 24. Air flow proceeds according to arrow 52 as the recirculation fan 18 pushes air through the recirculation fan 18 and according to directional arrow 54 and into the dishwasher unit.

Figure 3:
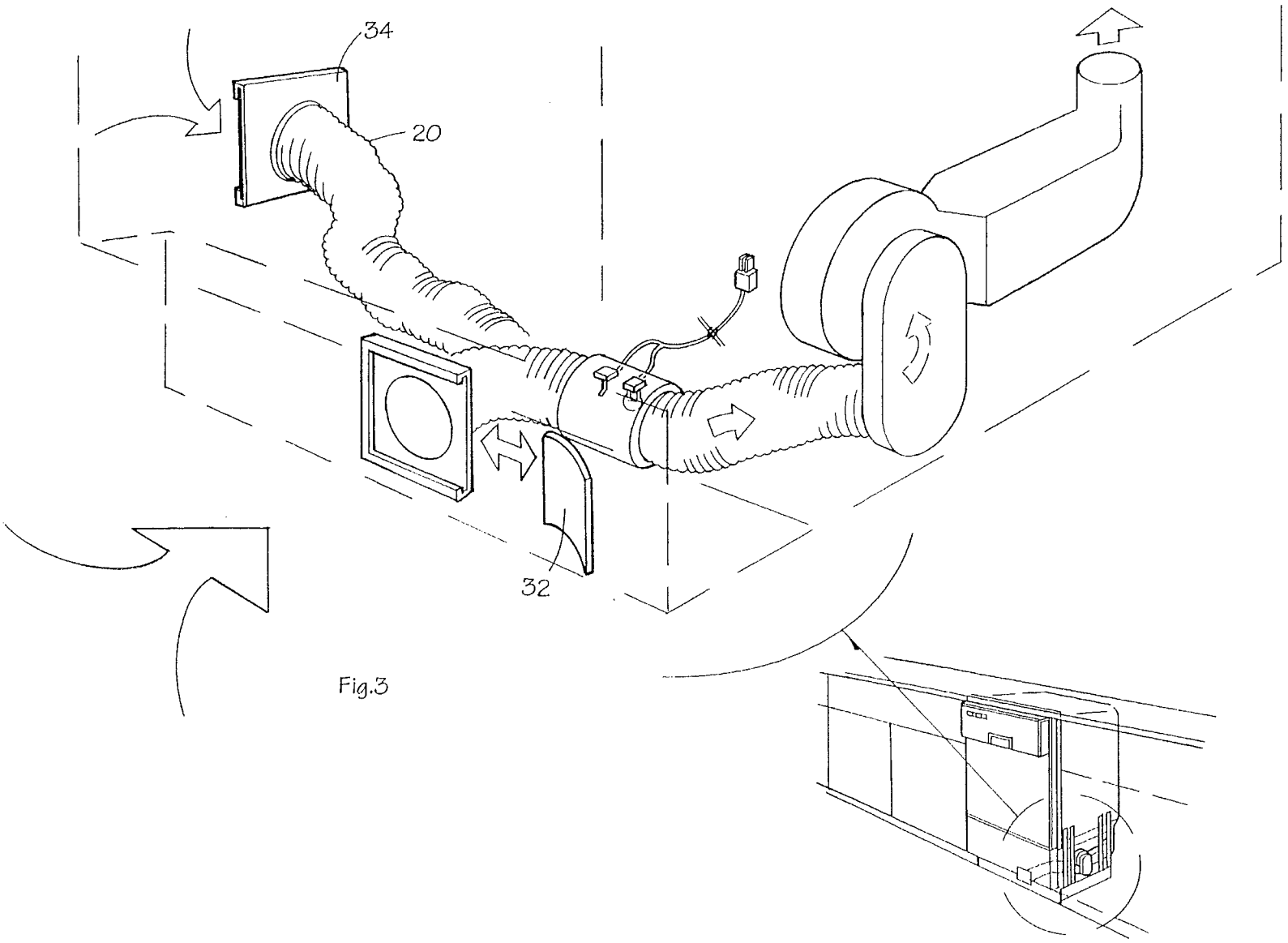
FIG. 3 is a pictorial view illustrating an alternative filter placement position in a cabinet adjacent to the dishwasher.

FIG. 3 illustrates alternative placement of the flexible duct 20 with filter support bracket 34 located on a side wall adjacent to the dishwasher eliminating the need for modifying the front panel of the dishwasher. Providing an inlet located within a cabinet prevents dirt and dust from clogging the filter 32.

Figure 4:
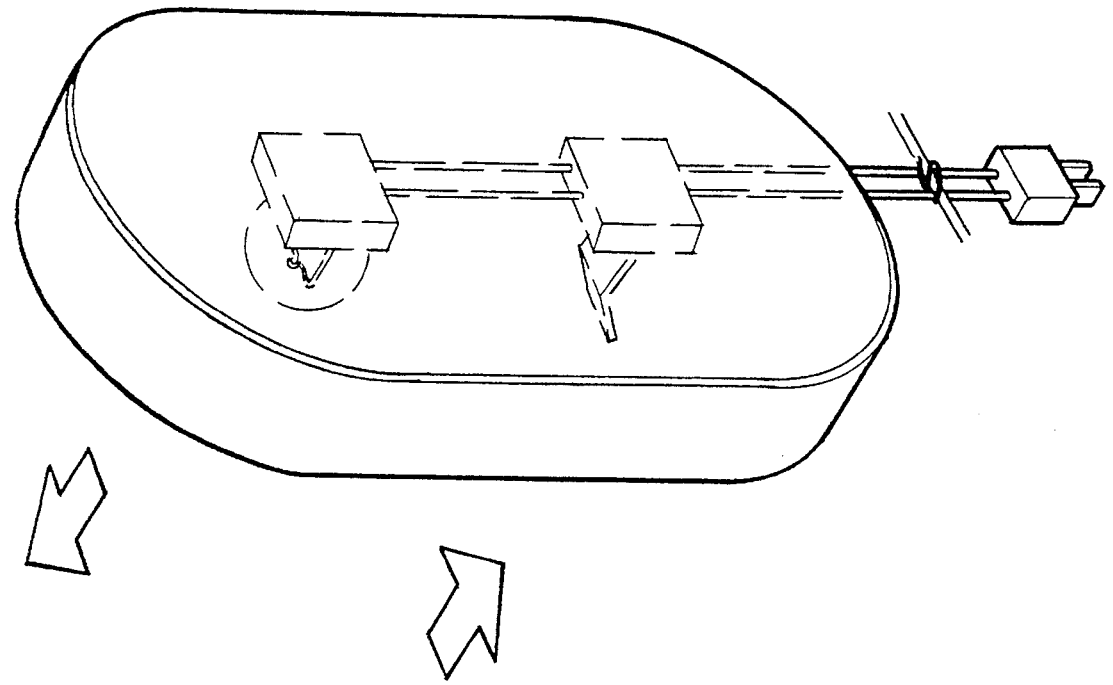
FIG. 4 is a perspective view of an air intake coupling housing having a germicidal light and sail switch incorporated therein.
Figure 4:
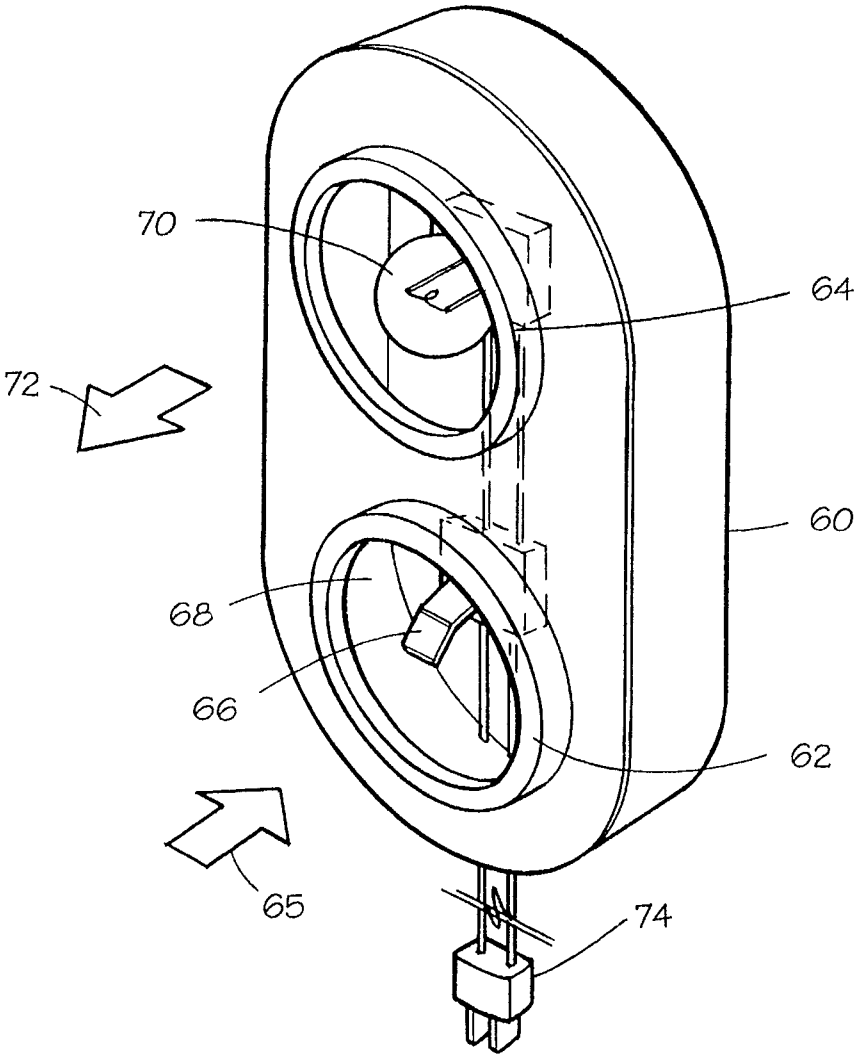

FIG. 4 is yet another embodiment of the U-shaped coupling housing wherein a housing 60 is constructed of a rigid material such as galvanized steel with an inlet 62 and an outlet 64. It is noted that other rigid materials such as plastic may be used, however, galvanized steel is known for its inability to promote bacterial growth. The inlet 62 is attached to the duct allowing air to enter in the direction of the arrow 65 to engage sail switch 66 as it enters the interior chamber 68 of the housing 60. The air is directed past germicidal lamp 70 and through outlet 64 in the direction of arrow 72. In this manner the duct may be routed around sharp angles without need for accommodating a sail switch or protecting the fragile germicidal lamp. Electrical cord 74 is plugged into an electrical outlet as previously described, alternatively the sail switch may be disabled and the electrical cord wired into the blower motor allowing lamp operation only when the blower motor is operated.

Figure 5:
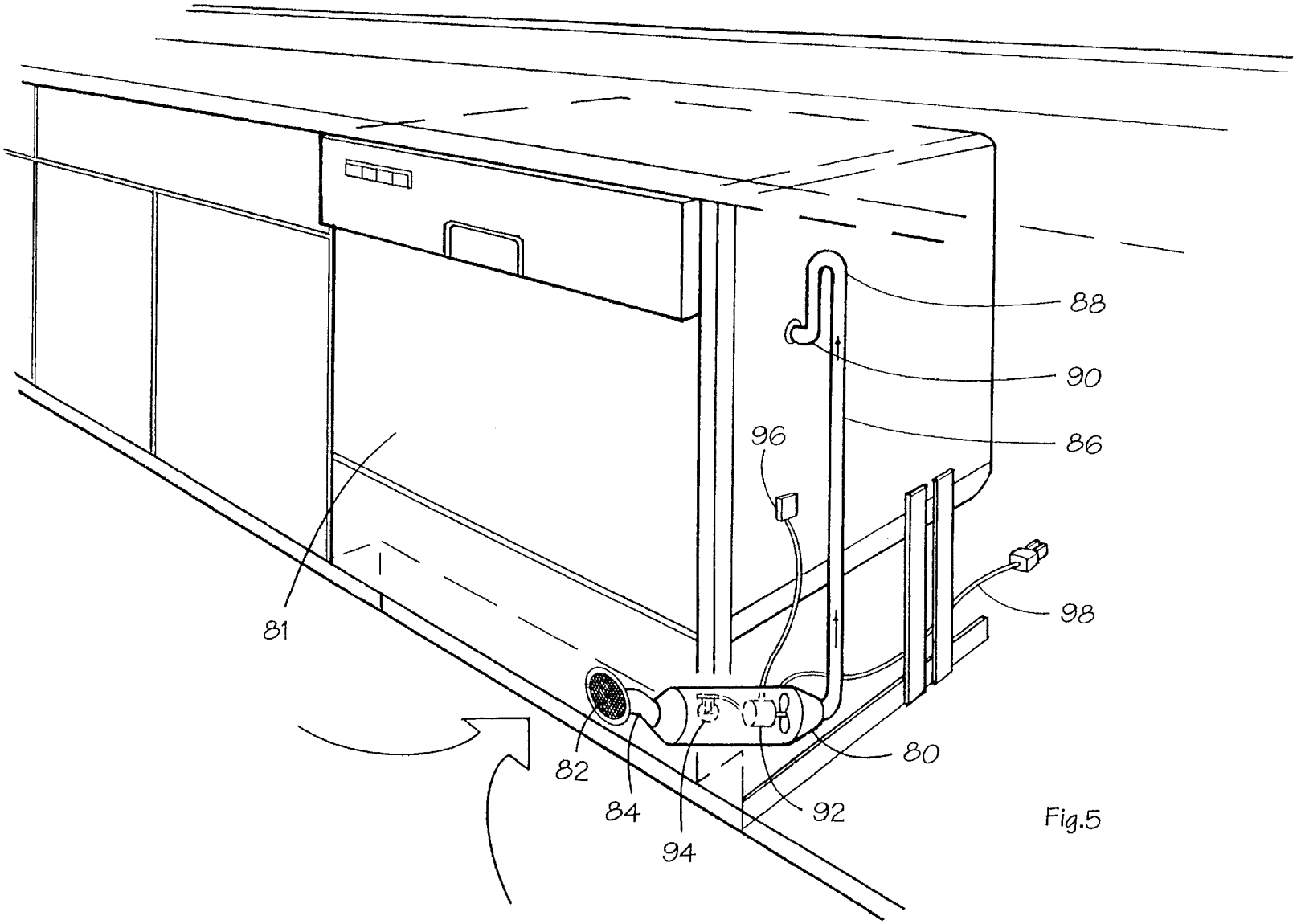
FIG. 5 is a pictorial view of a dishwasher having an integrated filtration and circulation fan for adapting to a conventional dishwasher relying on convection air flow.

FIG. 5 illustrates a variation of the kit for use with convection type dishwasher 81. A housing 80 accepts filtered air by use of an externally placed filter 82 with flexible duct 84 leading to the housing 80 followed by a solid coupling pipe 86 such as PVC plastic having an upper portion 88 located higher than inlet 90 to prevent accidental backflow of water into the housing 80. The housing 80 includes recirculation fan 92 and a germicidal lamp 94 made operational during dishwasher drying operation by sensor 96 by use of a thermostat or the like resistor made operable upon the detection of heat. Electrical cord 98 allows the device to be plugged into a 110 volt electrical outlet.

Figure 6:
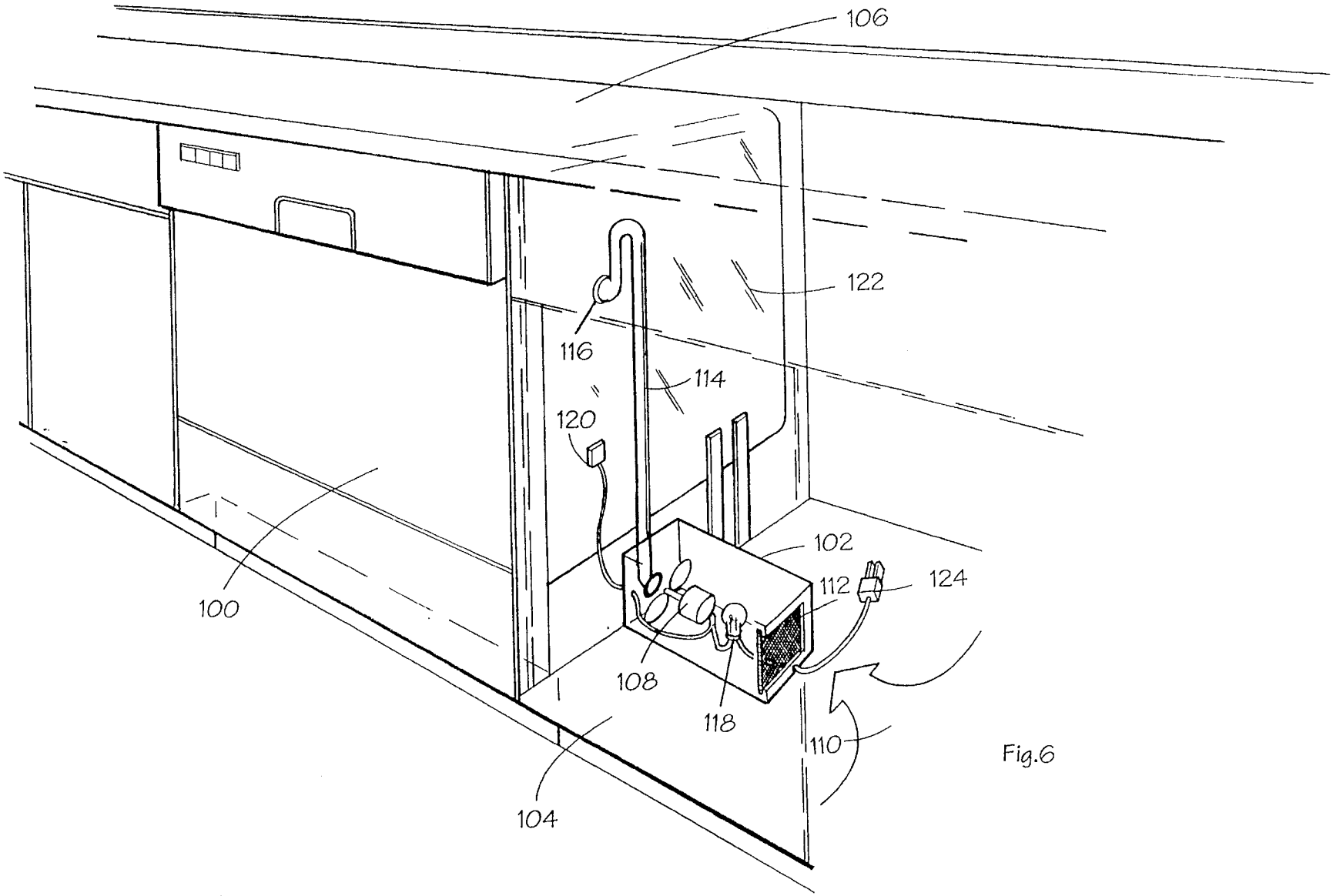
FIG. 6 is an alternative embodiment of FIG. 5 illustrating placement of the integrated device in a location adjacent to a dishwasher.

FIG. 6 provides a modified embodiment of FIG. 5 disclosing an alternative external kit for filtration. Housing 102 is placed in an area 104 adjacent to the dishwasher 100 such as beneath a kitchen sink or separate cabinet beneath the counter top 106. The kit comprises a recirculation fan 108 placed within the housing 102 for drawing air as depicted by arrow 110 into the housing through disposable filter 112 propelling the air through connection pipe 114 coupled to the dishwasher 100 through hole 116 along an upper portion of the dishwasher side wall. The germicidal lamp 118 is placed within the enclosure 102 so as to disinfect the air drawn through the enclosure and provide residual ozone to disinfect the dishes and eating utensils within the dishwasher. Sensor 120 may be coupled to the fan 108 causing operation during the heating cycle by use of a resistor capable of detecting the increased heat through the side wall 122 of the dishwasher which occurs during the drying cycle. The heat sensor allows a continuous disinfection when the drying cycle is complete as the sensor maintains treated air if convection is still possible. Electrical cord 124 is plugged into a conventional household electrical outlet, not shown, allowing the kit to be self-contained for ease of installation.

Figure 7:
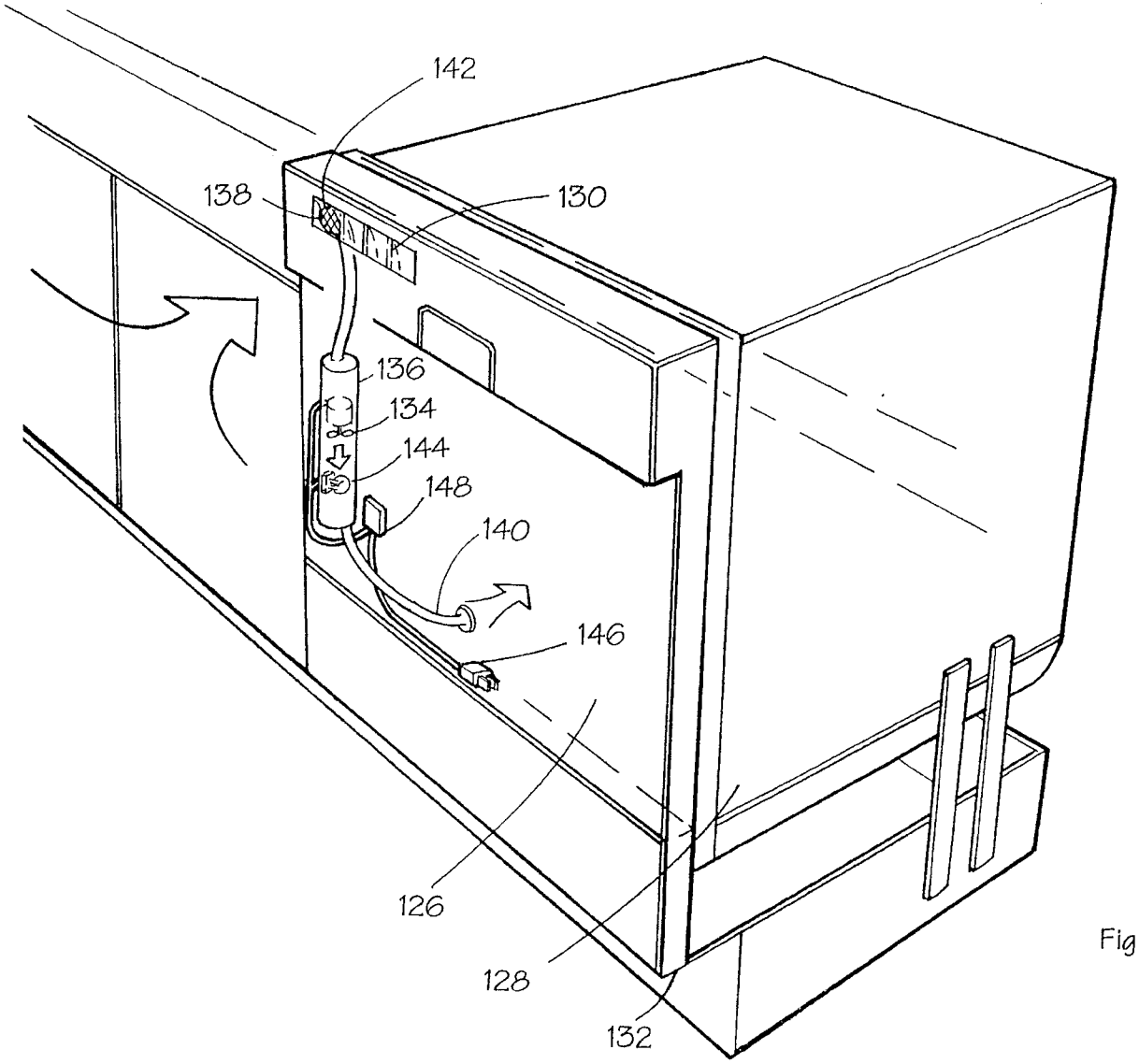
FIG. 7 is a pictorial view of an integrated device in a door of the dishwasher.

Referring to FIG. 7 it is noted that the idea of the instant invention is to provide filtration and/or disinfection of the air entering the dishwasher. For this reason, the aforementioned kit components may be integrated into the door 126 of a dishwasher 128 by placement within the hollow cavity typical of dishwashers which use the cavity to prevent external condensation. This embodiment operates to accommodate dishwashers such as the GE dishwasher set forth in U.S. Pat. No. 4,179,821 which has a vent 130 located along the top portion of the dishwasher and an inlet located along a bottom edge of the dishwasher door 126. The recirculation fan 134 is placed within a housing 136 having inlet 138 inserted through one of the vent openings 130. Outlet 140 to the housing 136 allows air to flow into the dishwasher. By use of fan 134, air can be drawn from a higher elevation so as to avoid the need for an enlarged screen 142 placed over the inlet 138 as the larger particles which accumulate along the floor will not be drawn in at a raised inlet. By use of the recirculation fan 134 the device is capable of providing sufficient air into the dishwasher so as to alleviate the need for pulling air through the lower inlet 132 effectively disabling the lower inlet 132. This allows the inlet to replenish the air should the recirculation fan fail. The fan provides sufficient air pressure in the dishwasher to prevent air from entering the inlet 132 allowing only treated air to be brought into the apparatus. Treated air may be further disinfected by ozonator 144 made operational by a heat sensing sensor 148 with an electrical power 146 coupled to the dishwasher providing operation through the drying cycle and as long as the temperature is sufficient to energize the sensor 148 to prevent untreated air during times of convection.

Figure 8:
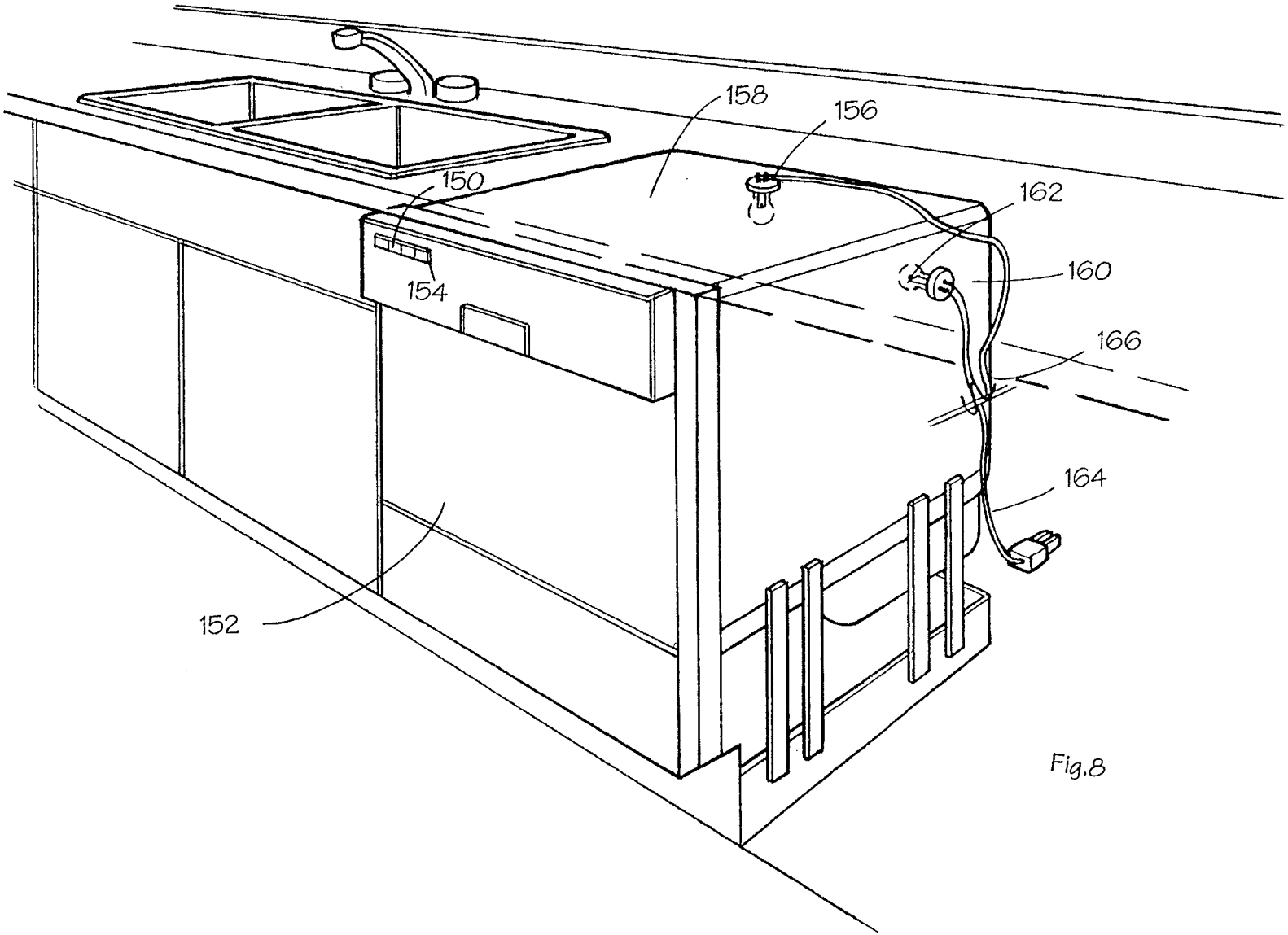
FIG. 8 is a pictorial view of a dishwasher having an ozonator placed within the dishwasher housing.

As shown in FIG. 8 it should be noted that dishwashers may incorporate my invention without need of the kit and it is deemed encompassed by this invention that placement of a vent screen 150 in a vent opening on a dishwasher 152 would allow a manufacturer to place the vent opening 154 along any location convenient with integrated duct work coupling the ventilation inlet to the recirculation fan. This would further allow the use of a separately placed ozonator 156 along a top wall 158 or ozonator 162 along side wall 160. The ozonators 156, 162 could be installed after market if the manufacturer has incorporated my ventilation filter by use of an external cord 164 wired into the drying cycle of the dishwasher or coupled directly to an electrical outlet wherein sensor 166 will cause the ozonator to operate upon an increase of heat within the dishwasher cavity.

Figure 9:
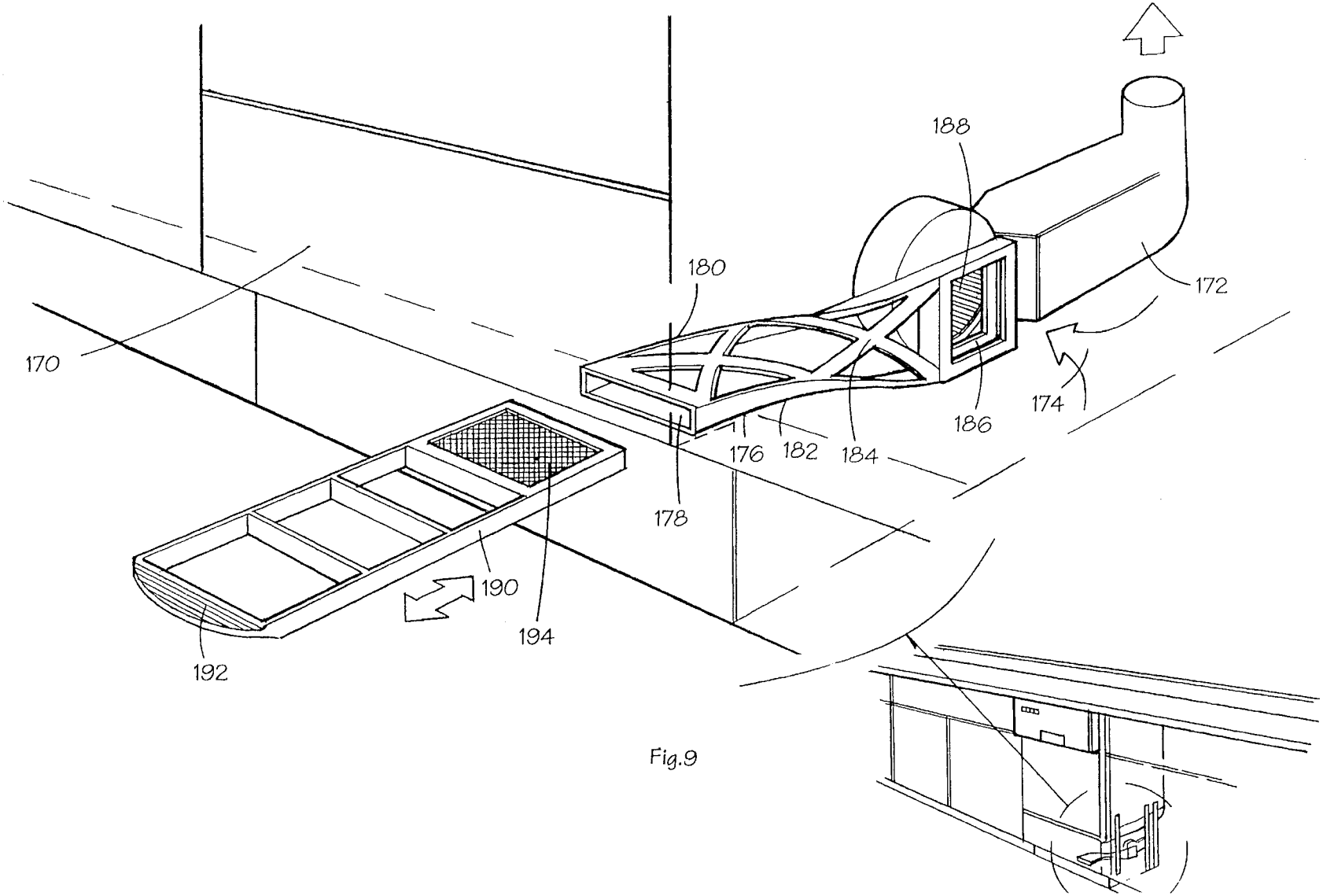
FIG. 9 is a pictorial view of a twist filter housing for attachment to the intake port of an air circulation fan.
Figure 10:
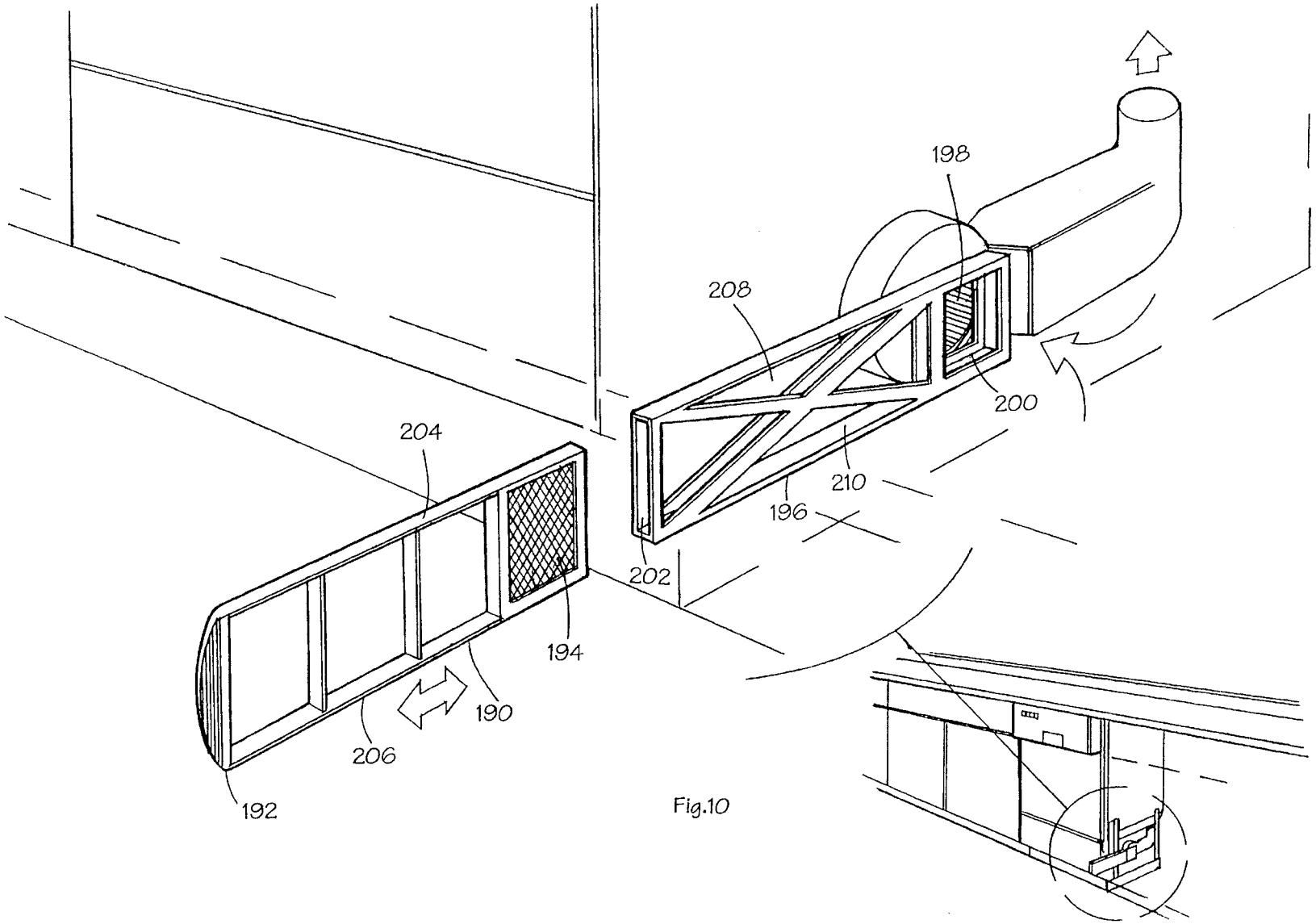
FIG. 10 is a pictorial of a straight filter housing for attachment to the intake port of an air circulation fan.

FIGS. 9 and 10 set forth an alternative embodiment to the use of a ventilation filter for a dishwasher having difficult to reach intake systems and insufficient space to accommodate separate duct work. As shown in FIG. 9, dishwasher 170 has recirculation fan housing 172 which encompasses a blower fan to draw air into the opening as denoted by numeral 174 depicting air flow. In this manner, a housing 176 provides an opening 178 with an upper side wall 180 and lower side wall 182 supported by side surfaces 184. An opening 186 is placed directly over fan inlet 188 with filter holder 190 made of flexible plastic insertable into the opening 178 wherein insertion of the filter holder 190 by handle 192 will cause the structure to bend according to the curvature set by housing 176 and 180 so as to place filter 194 directly into opening 186 thereby filtering the air before it enters fan inlet 188. The handle 192 would be exposed and accessible along the outer surface of the dishwasher 170 allowing the homeowner to simply pull on the handle 192 so as to access the filter 194 for ease of cleaning.

As shown in FIG. 10 the same filter housing 190 having handle 192 and filter 194 may be placed into filter holder 196 providing direct access to fan inlet 198 by provision of filter opening 200. In a similar manner to FIG. 9, the filter housing 190 is inserted through opening 202 wherein the upper side edge 204 and lower side edge 206 of the filter holder 190 is slidably inserted along upper edge 208 and lower edge 210 of opening 202 maintaining the filter housing 190 in position for placement of the filter 194 into the filter opening 200 thereby allowing all air that enters fan inlet 198 to be properly filtered.

The filter of the instant invention may be constructed of non-degradable fiber elements such as plastic or fiber glass so as to trap large particles with minimal air restriction. In those instances where a recirculation fan is provided, the filter may have a decreased micron rating such as that provided by polypropylene spun filter having the ability to trap particles greater than 0.2 microns. The filter may further be impregnated with activated carbon capable of absorbing various vapors including household cleaners, disinfectants, paints, pesticides, formaldehyde, and the like chemical vapors. It should be noted that if the primary filter is used, the activated carbon can be located down stream of the ozonator so as to destroy excess ozone and further operate to trap radiated bacteria to prevent the distribution of dead spores throughout the dishwasher.

Figure 11:
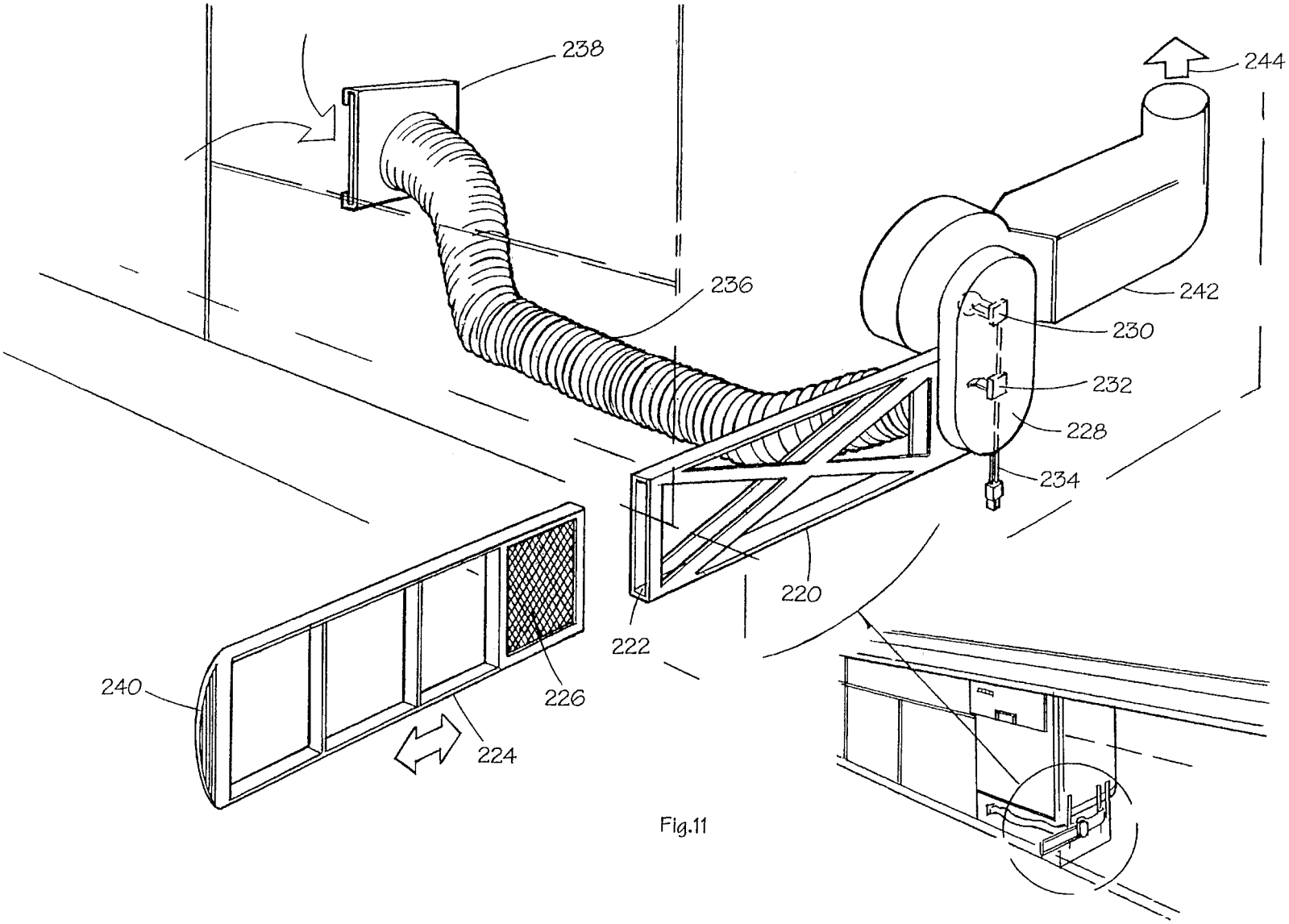
FIG. 11 is a pictorial of a straight filter housing including a flexible tube for intake of air from an adjacent cabinet.

FIG. 11 sets forth an alternative embodiment of the instant invention by combining previously described embodiments. In this manner, filter housing 220 is shown with opening 222 available for the slidable insertion of filter holder 224. Filter 226 is positioned to treat air directly before intake opening of the U-shaped housing 228 illustrated with UV light 230 coupled to sail switch 232 with an electrical power supply provided through electrical cord 234.

The variation of this embodiment is provided by incorporating flexible housing 236 to allow for the remote positioning of filter support 238 allowing intake of air from an area adjacent to the dishwasher. A filter placed into filter support 238 lessens the amount of debris that may clog filter 226. A benefit is in those instance where there is a high accumulation of floor debris such as those homes having dogs or cats. The filter holder 224 may be slid out of opening 222 by grasping handle 240. Dual filtration allows the use of a large micron filter placement in filter support 238 such as a 5 micron filter which would lessen the burden on the secondary filter 226 which may be a sub-micron filter capable of trapping bacteria. In many instances the placement of the air intake in an environment that is clean may eliminate the necessity for a primary filter. Support housing 238 is a U-shaped structure as previously described and is coupled to the air recirculation fan 242 used to draw air for insertion into a dishwasher in a direction as shown by arrow 244.

It is to be understood that while I have illustrated and described a certain form of my invention, it is not to be limited to the specific form or arrangement of parts herein described and shown. It will be readily apparent to those skilled in the art that various changes may be made without departing from the scope of the invention and the invention is not to be limited to what is shown in the drawings and described in this specification.

What is claimed is:

1. A dishwasher ventilation filtration kit comprising: a housing means having an air inlet and outlet opening and a filtered air outlet opening, a filter support bracket coupled to said inlet opening; filter means insertable into said filter support bracket; means for coupling said outlet opening to an air intake opening on a dishwasher; whereby air drawn into dishwasher passes through said air filter for removal of debris.

2. The filtration kit according to claim 1 wherein said housing means is further defined as an elongated tube having a continuous flexible side wall defining an interior chamber therebetween, said housing means providing a spacing between said inlet opening and said outlet opening for locating said air filter remotely from said air intake opening of said dishwasher.

3. The air filtration kit according to claim 1 wherein said support bracket is adaptable to a vertical panel having a plurality of mounting holes receptive to mounting fasteners for use in placing said support bracket in a side wall of a dishwasher cabinet adjacent to the dishwasher.

4. The filtration kit according to claim 1 wherein said filter means is further defined as an air permeable membrane having a 5 micron or less filtration rating.

5. The filtration kit according to claim 1 wherein said housing means includes an ultraviolet lamp mounted therein to disinfect air passing through said housing means.

6. The filtration kit according to claim 5 wherein said ultraviolet lamp produces an ozone residual.

7. The filtration kit according to claim 5 including a detection sensor electrically coupled to said ultraviolet lamp providing automatic operation of said ultraviolet lamp, said detection sensor having a length of electrical cord for insertion into a conventional electrical outlet.

8. The filtration kit according to claim 7 wherein said detection sensor is a sail switch, said sail switch detecting air passing through said housing means for operation of said ultraviolet lamp.

9. The filtration kit according to claim 7 wherein said detection sensor is a heat rheostat electrically coupled to said ultraviolet lamp providing automatic operation of said ultraviolet lamp upon detection of heat created by the drying cycle of a dishwasher, said detection sensor having a length of electrical cord for insertion into a conventional electrical outlet.

10. The filtration kit according to claim 1 wherein said inlet opening is disposed collinearly with said outlet opening.

11. The filtration kit according to claim 1 wherein said inlet opening is disposed non-collinearly with said outlet opening.

12. The filtration kit according to claim 1 wherein said housing means is coupled to an elongated tube having a continuous flexible side wall providing a spacing between said housing means and an inlet opening for remotely drawing air.

13. A dishwasher ventilation filtration kit comprising: a housing means having an elongated tube with a continuous flexible side wall defining an interior chamber therebetween, said housing having an inlet opening with a filter support bracket coupled thereto and a plurality of mounting holes receptive to fasteners for use in mounting said support bracket adjacent to a dishwasher and an outlet opening; filter means insertable into said filter support bracket; ultraviolet lamp disposed in said housing means to disinfect air drawn through said housing means; means for energizing said ultraviolet lamp; and means for coupling said outlet opening to an air intake opening on a dishwasher; whereby air drawn into said dishwasher passes through said air filter for removal of debris and is disinfected by said ultraviolet lamp.

14. The filtration kit according to claim 13 wherein said ultraviolet lamp generates ozone.

15. The filtration kit according to claim 13 wherein said housing means includes an air flow detection sensor, said sensor electrically coupled to said ultraviolet lamp providing automatic operation of said ultraviolet lamp upon detection of air passing through said housing means, said detection sensor having a length of electrical cord for insertion into a conventional electrical outlet.

16. The filtration kit according to claim 14 wherein said air flow detection sensor is a sail switch.

17. The filtration kit according to claim 13 wherein said housing means includes a heat detection sensor, said sensor electrically coupled to said ultraviolet lamp providing automatic operation of said ultraviolet lamp upon detection of heat created by the drying cycle of a dishwasher, said detection sensor having a length of electrical cord for insertion into a conventional electrical outlet.

18. The filtration kit according to claim 13 wherein said housing means is fabricated from plastic.

19. The filtration kit according to claim 13 including a electric fan.

20. A dishwasher ventilation filtration kit comprising: a housing means having an elongated tube with a continuous flexible side wall defining an interior chamber therebetween, said housing having an inlet opening with a filter support bracket coupled thereto and a plurality of mounting holes receptive to fasteners for use in mounting said support bracket adjacent to a dishwasher and an outlet opening; filter means insertable into said filter support bracket; ozonator disposed in said housing means to disinfect air drawn through said housing means; means for energizing said ozonator; electric fan for drawing air through said housing means for distribution into a dishwasher; and a means for coupling said outlet opening to an air intake opening on the dishwasher; whereby is air drawn into said dishwasher by said fan wherein the air is treated by passing said air for removal of debris and adding a residual amount of ozone.

* * * * *